US005593301A

United States Patent [19]

Garrison et al.

[11] Patent Number: 5,593,301

[45] Date of Patent: Jan. 14, 1997

[54] APPARATUS AND METHOD FOR BURNING ENERGETIC MATERIAL

[75] Inventors: Millard M. Garrison, Edina; Paul L. Miller, Minnetonka, both of Minn.

[73] Assignee: Alliant Techsystems, Inc., Edina, Minn.

[21] Appl. No.: 89,240

[22] Filed: Jul. 9, 1993

[51] Int. Cl.[6] ..... F23D 14/46

[52] U.S. Cl. ..... 431/350; 431/353; 431/354; 431/8; 110/237; 110/322; 110/260; 110/261; 588/202

[58] Field of Search ..... 60/749; 431/353, 431/350, 354, 819; 588/202; 110/260, 261, 262, 237, 322

[56] References Cited

U.S. PATENT DOCUMENTS

| | | | |
|---|---|---|---|
| 3,848,548 | 11/1974 | Bolejack, Jr. et al. | 110/7 |
| 3,878,287 | 4/1975 | Muller et al. | 423/153 |
| 4,473,014 | 9/1984 | Dejanovich | 110/264 |
| 4,612,865 | 9/1986 | Nilsson et al. | 110/244 |
| 4,790,744 | 12/1988 | Bellet et al. | 431/75 |
| 4,802,337 | 2/1989 | Caruel | 60/749 |
| 4,864,943 | 9/1989 | Young | 110/261 |

FOREIGN PATENT DOCUMENTS

| | | |
|---|---|---|
| 0001437 | 4/1979 | European Pat. Off. . |
| 0235031 | 9/1987 | European Pat. Off. . |
| 0242249 | 10/1987 | European Pat. Off. . |
| 0296773 | 12/1988 | European Pat. Off. . |
| 2424480 | 11/1979 | France . |
| 661489 | 7/1978 | U.S.S.R. . |
| 667766 | 6/1979 | U.S.S.R. . |
| 996799 | 2/1983 | U.S.S.R. . |
| 1085943 | 4/1984 | U.S.S.R. . |
| 2041504 | 9/1980 | United Kingdom . |
| 2044422 | 10/1980 | United Kingdom . |
| 2059031 | 4/1981 | United Kingdom . |

OTHER PUBLICATIONS

AD–764534—Treatment and Disposal of High–Energy Materials (1973).
AD–892518—The Thermal Destructor (1971).
AD–919178—Design Guide for Propellant and Explosive Waste Incineration (1973).
A91–56137—Flame Stability and Lean Blowout (1991).
A91–56140—On the Performance of a Small, Conventional Combustor Burning a Variety of Fuels (1991).
AD–A064124—Fluidized Bed Incinerator For Disposal of Propellants and Explosives (1978).
AD–A170492—Phase Change Thermal Energy Storage Methods for Combat Vehicles (1986).
AD–A22270—Laboratory Tests to Determine the Chemical and Physical Characteristics of Propellant–Solvent–Fuel Oil Mixtures (1990).
AD–P004142—Incinerator of Explosives Contaminated Soils (1984).
AD–B001119—Development of a Fluidized Bed Incinerator for Explosives and Propellants (1973).
AD–BO22450—The Incineration Properties of Surplus Military PEPs (1977).

(List continued on next page.)

*Primary Examiner*—Ngclan Mai
*Attorney, Agent, or Firm*—Merchant, Gould, Smith, Edell, Welter & Schmidt

[57] ABSTRACT

An apparatus and method for burning combustible material are provided. The apparatus has a combustion chamber with an intake and an exhaust end, a means for injecting combustible material into the intake end of the chamber, a means for igniting the combustible material to generate a flame front, and a means for providing a variance in pressure in the chamber between the intake end and the ignition means, so that a flame front is held substantially stationary in the chamber adjacent the pressure variance means. In its most preferred mode, the apparatus and method may be used for burning energetic materials which, due to their highly volatile and reactive properties, present unique hazards above and beyond those encountered with less reactive non-energetic combustible materials.

21 Claims, 5 Drawing Sheets

OTHER PUBLICATIONS

AD–B045435—Comparison of Fluidized Bed Incinerators and APE 1236 Deactivation Furnace for Disposal of Explosive Munitions and Explosive Wastes (1978).
AD–B045722—Use of a Modified APE 2048 Flashing Furnace as a Contaminated Waste Incinerator (1978).
COO–4462–1—Rotary Kiln Waste Energy Recovery and Conversion (1977).
DE83–013604—Combustion Characterization of Coals for Industrial Applications (1983).
DE86–003098—Utilization of Energetic Material as a Supplementary Boiler Fuel (1985).
DE86–003959—Shredder and Incinerator Technology for Treatment of Commercial Transuranic Wastes (1985).
DE88–012162—Power Generation from Waste Incineration (1988).
DE89–013657—Pilot–Scale Testing of a Fuel Oil–Explosives Cofiring Process for Recovering Energy from Waste Explosives (1988).
DE89–016080—Use of Waste Energetic Materials as a Fuel Supplement in Utility Boilers (1989).
NASA TN D–4996—Performance of Swirl–Can Turbojet Combustors at Simulated Supersonic Combustor–Inlet Conditions (1969).
NASA TN D–5668—Preliminary Tests of a Simplified Modular Turbojet Combustor (1970).
NASA TN D–5733—Stability Limits and Efficiency of Swirl–Can Combustor Modules Burning Natural Gas Fuel (1970).
N91–23058—Advanced Thermal Control Technology for Commercial Applications (1991).
MLM 2762 (OP)—Harrison et al., "Mound Facility Explosives Incinerator" (1980).
Bishop et al., "RCRA Upgrade of APE–1236 Deactivation Furnaces", JANNAF Safety & Environmental Protection Subcommittee Meeting (1991).
Cox et al., "Recent Advances in Acid Dewpoint Investigations" (no date).
Moore, "Self–Recuperative Burner Applications", Heat Recovery Systems (1982).
Nagarajan et al., "Corrosion of Nickel–Base and Iron–Base Alloys in a Simulated Fluidized–Bed Coal–Combustion Environment", Oxidation of Metals, vol. 31, Nos. 1/2 (1989).
McGown et al., "Hazardous Waste Incineration", Chemical Engineering (1991).
Kimura et al., "Combustion and Deposition in Coal–Fired Turbines", Journal of Engineering for Gas Turbines & Power (1987).
Hayhurst et al., "The Combustion of Carbon Monoxide in a Two–Zone Fluidized Bed", Combustion and Flame (1990).
Barner et al., "Application of Circulating Fluid Bed Technology to the Combustion of Waste Materials", Environmental Progress (vol. 4, No. 2) (1985).
Ryner et al., "Capital Costs of Resource Recovery Facilities in the U.S.A.", Waste Management & Research (1986).
Lasday, "Development of Cellulose Waste Converter to Recycle Materials and Product Energy", Industrial Heating (1978).
Green et al., "Aerodynamic device for generating mono–disperse fuel droplets", Rev. Sci. Instrum. 60(4) (1989).
Norwood et al., "Feasibility of Using Propellant–Fuel Oil Slurries as Supplemental Fuels" (no date).
MIC–91–04555—Absorption of Miscellaneous Liquid Wastes on Sawdust (1990).
Regulation of Combustion Plants for Rubbish and Similar Combustible Materials, 17. BlmSchV (1990) (German Environmental Regulation).
"Afterburner" article, McGraw Hill Concise Encyclopedia of Science & Technology, 2nd Ed. (1989) pp. 32–33.
"Eductors and Ejectors", Fox Value Development Corporation (1989).

FIG.2B
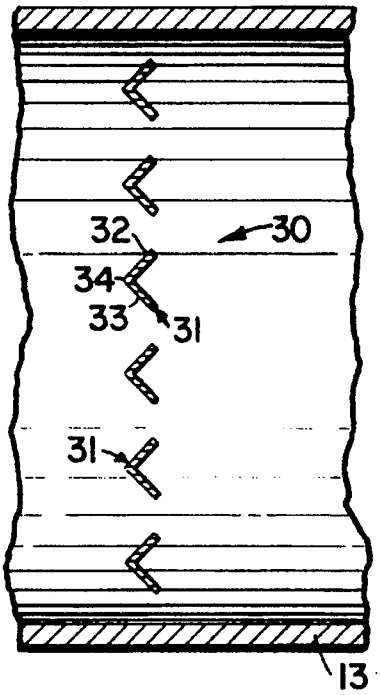
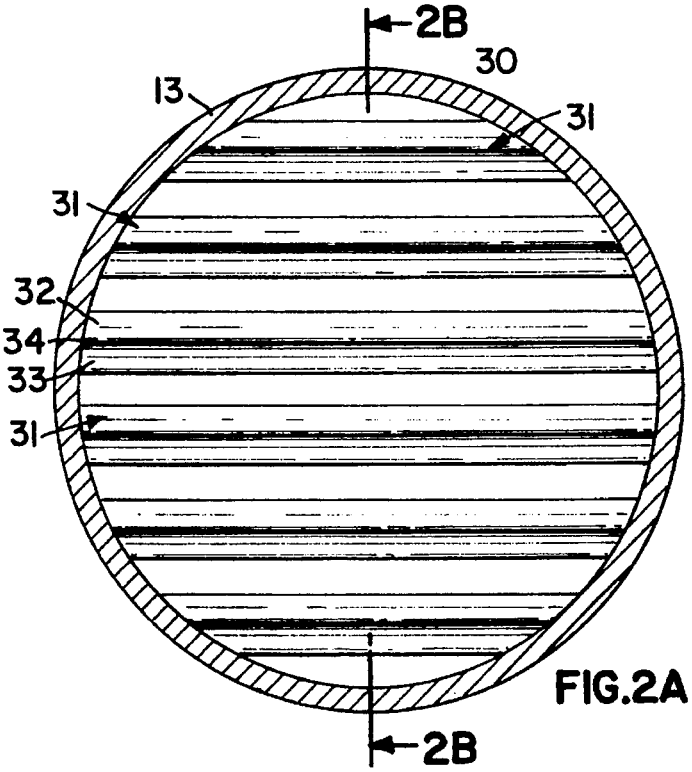
FIG.2A
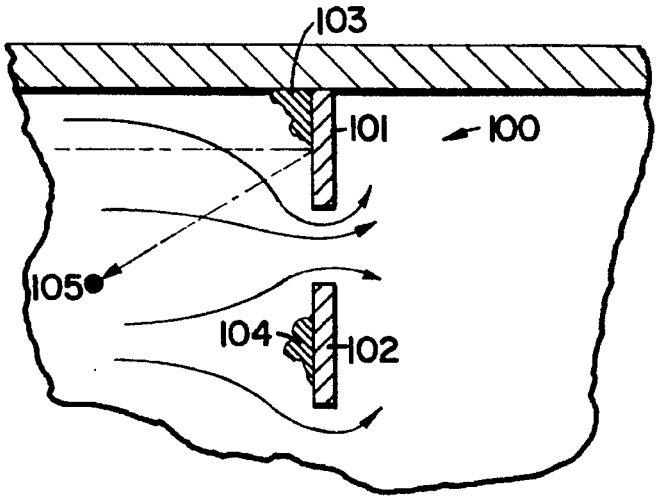
FIG.3
PRIOR ART

APPARATUS AND METHOD FOR BURNING ENERGETIC MATERIAL

FIELD OF THE INVENTION

The invention generally relates to apparatus and methods for the disposal of combustible material. More particularly, the invention is directed to the disposal of waste energetic material such as explosives, propellants, and pyrotechnics using an apparatus and method for combusting the energetic material whereby the energetic material is injected at a rate greater than the flame propagation rate of the energetic material with reduced risk of flashback, blow out or uncontrolled explosion.

Background of the Invention

Waste energetic stockpiles pose an increasing problem for many countries. Millions of tons of material are stockpiled in the world today, including energetics produced as far back as the First and Second World Wars. Much of this waste is toxic and/or hazardous, and runs the risk of contaminating soil or ground water, as well as endangering the safety of personnel. Therefore, a need has existed for safely and efficiently disposing of these materials.

These waste energetic materials may be generated during the normal process of manufacturing energetics. Energetics which do not conform to ballistic, chemical, or physical specifications may be unusable and require disposal. Waste may also be generated during the loading of munitions through equipment wash down procedures. Waste energetics may also be generated through stockpiles becoming unserviceable due to obsolescence or degradation. However, regardless of the reason, the waste energetic materials found in these stockpiles must be disposed of in a safe and environmentally clean manner.

The preferred manner of disposing of waste energetic material today is to burn it. However, unlike many standard fuels or materials which are burned, such as fuel oil, natural gas, or coal, the combustion properties and by-products of energetics present unique problems during the combustion of these materials.

Energetic materials typically have burn rates which are significantly greater than many conventional fuels such as coal, fuel oil, or gas, typically on the order of several magnitudes. For example, cyclotrimethylenetrinitramine (RDX), a commonly used high explosive, has a burn rate, during detonation, of about 20 kilometers/second, while hydrogen, one of the fastest burning conventional fuels, has a burn rate of about 5 meters/second at best.

Due to the high burn rates, most energetics are difficult to burn controllably. They are easily ignitable, and may progress rapidly through burning, deflagration, and detonation. The burn rates of many energetic materials can also be widely varying and unpredictable. Most standard non-energetic fuels burn regressively, that is, the combustion rate decreases with decreasing fuel. Energetic particles may burn at varying combustion rates, including progressively, due to, for example, surface perforations which may increase the surface area of the fuel during combustion. The risk of pressure excursions, or explosions, during combustion may be great with some energetics if not carefully controlled due to their unpredictable and unstable combustion properties.

Most energetics also do not require the addition of oxygen to combust, as oxygen may be present within the structure of the energetic particles. Therefore, unlike many standard carbonaceous fuels, the combustion of energetics is not easily regulated by simply varying the combustion air flow.

Thus, unique dangers exist in burning energetic material which are not present when using many standard non-energetic fuels and materials. Originally, waste energetics were disposed of through open-air burning or open-air detonation. While these practices are simple, relatively safe, and expedient, there is no control over the pollution generated. Also, some concerns are raised due to the exposure of personnel to some of these materials. Finally, open-air burning or detonation does not utilize any of the heating value of these energetic materials.

Another type of disposal for waste energetic material is through incineration. Typically, the energetics are mixed with water to form a slurry, and are then fed into an incinerator, which ignites the energetic material after the water has evaporated. The type of incinerator used is typically a vertical induced draft, a rotary kiln, or a fluidized bed incinerator. One rotary kiln incinerator is described in U.S. Pat. No. 3,949,548, issued to Bolejack, Jr. et al.

Incineration typically requires the use of slurry tanks and mixers in order to properly prepare energetic materials for incineration. Generally, the energetics are mixed with water in a large tank and continuously stirred and pumped in order to keep the energetics in a slurry mixture. Slurry incineration also requires injection at high pressure either by the mixing pump, or by a steam ejector.

In addition, because the burning properties of many energetics are difficult to control and often unpredictable, the above incinerators may be dangerous or unusable with some energetics. After the water in the slurry has evaporated, the energetics are allowed to heat and ignite uncontrollably. This may result in unpredictable ignition points and flashback if too much energetic material is deposited in an incinerator prior to ignition. These incinerators also do not utilize the energy content of the energetics.

Attempts have been made to utilize some of the energy stored in waste energetics during disposal by burning the energetics in a boiler or furnace along with other fuels. The majority of these systems are simply variations on the energetic incinerators, using an energetic/fuel oil slurry in place of an energetic/water slurry. However, these systems require the same tanks and mixing apparatus as energetic incinerators. Certain energetics are often not readily dissolvable in fuel oil and must be continually mixed and pumped in order to keep the slurry composition homogenous. Also, solvents must be added in some cases in order to facilitate the dissolving of the energetics in the slurry. Since different energetics have different properties, special mixtures and ratios must be used in order to provide different types of energetics in these boilers. Thus, these types of cofiring systems require extensive machinery and processing in order to work effectively.

Also, the energetic/fuel oil slurries still require a great deal of fuel oil in order to work properly. Typically, the percentage of energetics is limited to under 30% by weight in the slurry. The remainder will typically be made up of fuel oil, and possibly a solvent. Additional materials are still being expended in order to dispose of the energetics.

Many of the above energetic disposal systems are not capable of adequately controlling the burning of unpredictable, high energy energetics. The likelihood and danger from flashback is aggravated in the case of energetic fuel, since the energetics have such a high burn rate, and can quickly burn back into the fuel delivery system. Also, because many energetics require no additional oxygen, they may burn all of the way back to the fuel storage, resulting in an obvious safety hazard.

One partial solution to this problem is to inject the fuel into the incinerator or boiler at a rate faster than the flame propagation speed. For example, Muller et al., U.S. Pat. No. 3,878,287, uses flow rate to prevent corrosion of the injectors. A high flow rate, however, may produce flame blowout, when the rate of injection extinguishes the flame.

Another concern that is raised in many areas is assuring the complete combustion of any fuels or materials injected into an incinerator or boiler. It is undesirable and dangerous to eject partially-combusted materials from a device which could later ignite or explode. Previously, complete combustion was facilitated by increasing the dwell time of the material in the combustion chamber. For example, as seen in U.K. Patent Application 2,059,031 and Soviet Union Patent Application 996,799, disclose annular restrictions which decrease the diameter of the outlet of the incinerator or boiler. The pressure created by these restrictions typically slows the passage of material through the combustion chamber.

Many of these baffles may allow for reflection or buildup of some fuel immediately upstream of the baffles. For example, in U.K. Patent Application 2,059,031, the surfaces of the baffles are perpendicular to the flow of fuel through the furnace. Material is able to bounce off the baffle and reflect back into the chamber. Also, the eddies formed at the junction of the furnace wall and the baffle allow material to buildup in corners. This built up fuel may ignite and result in explosions.

Jet aircraft engines provide more thorough combustion with baffles which create turbulence in air flow prior to injection of fuel which provides greater mixing of fuel and air and increases the dwell time. However, by their position in the engine, these baffles cannot prevent flashback.

Finally, premature ignition has not been adequately addressed in the prior art. Energetics are typically unstable and easily ignitable. As a result, energetics run the risk of igniting anywhere in the fuel storage and delivery systems before their actual injection into a combustion system. This problem is typically addressed in the energetics field, as discussed above, by mixing the energetics with stable materials such as water or fuel oil. By mixing with additional materials, however, the associated drawbacks discussed above still exist.

Therefore, a need exists in the art for an energetic disposal system which is capable of recovering the energy of energetics in a safe and efficient manner.

SUMMARY OF THE INVENTION

The invention provides an apparatus and method for burning combustible material, and more particularly energetic material, which maintains a stable flame front in a combustion chamber by injecting the material into the chamber at a rate higher than the flame propagation rate of the material and igniting the material in the chamber between a pressure variance means and the exhaust end of the chamber. The stable flame front which is generated in the combustion chamber allows the energy content of the materials to be recovered and used in a safe and efficient manner. In particular, energetic materials may be efficiently disposed of, and their energy content recovered without concern for flashback, flame blowout, incomplete combustion, and premature ignition are reduced.

Energetic materials typically include explosives, propellants, and pyrotechnics. The U.S. Department of Transportation generally defines an explosive as any chemical compound, mixture, or device, for which the primary or common purpose of which is to function by explosion, i.e. with substantially instantaneous release of gas and heat. 37 C.F.R. § 173.50(a). Under Federal regulations, propellants and pyrotechnics are also generally included in the classification of explosive.

These materials are classified by the DOT based upon their volatility. An exhaustive, but by no means complete, list of energetics is provided in Subpart C of the Department of Transportation Research and Special Programs Administration Regulations, titled "Explosives and Blasting Agents; Definitions and Preparation", 37 C.F.R. §§ 173.50–173.114a (1990).

Energetic materials, for the purposes of this invention include at least those materials defined above as well as those which are defined as highly volatile materials having high burn rates which are generally above one meter/second (combustible material such as normal fuels, with the exception of hydrogen, generally have a flame speed of less than one meter/second). Examples include ammonium perchlorate (AP); 2,4,6-trinitro-1,3-benzenediamine (DATB); ammonium picrate (Exp D); octahydro-1,3,5,7-tetranitro-1,3,5,7-tetrazocine (HMX); nitrocellulose (NC); nitroguanidine (NQ); 1,3,5-propanetriol trinitrate (NG); 2,2-Bis[(nitroxy)methyl]-1,3 propanediol dinitrate (PETN); 2,4,6 trinitrophenol (TNP); hexahydro-1,3,5-trinitro-1,3,5-triazine (RDX); 2,4,6-trinitro-1,3,5-benzenetriamine (TATB); N-methyl N-2,4,6 tetranitro benzeneamine (TETRL); and 2-methyl-1,3,5 trinitrobenzene (TNT); among others.

In accordance with a first aspect of the invention, there is provided an apparatus for burning combustible material, including a combustion chamber with an intake and an exhaust end, a means for injecting combustible material into the intake end of the chamber, a means for igniting the combustible material positioned within the chamber, and a means for providing a variance in pressure in the chamber between the intake end and the ignition means. A flame front which has been generated by the ignition means in the chamber is held substantially stationary in the chamber adjacent the pressure variance means.

In accordance with an additional aspect of the invention, there is provided a method for burning combustible material in such a burner, which includes the step of injecting combustible material into the intake end of the chamber at a velocity greater than the flame propagation rate of the material, and igniting the combustible material in the chamber. A flame front is thereby generated and held substantially stationary in the chamber adjacent the pressure variance means.

BRIEF DESCRIPTION OF THE DRAWINGS

FIG. 2A is a cross-sectional view of one preferred baffle taken along lines 2A—2A in FIG. 1A, having only six bars of angle iron for clarity.

FIG. 2B is a cross-sectional view of the preferred baffle taken along lines 2B—2B in FIG. 2A.

FIG. 3 is an enlarged fragmentary cross-sectional view showing several phenomena associated with prior art flat plane baffles.

DETAILED DESCRIPTION OF THE PREFERRED EMBODIMENT

Figure 1A:
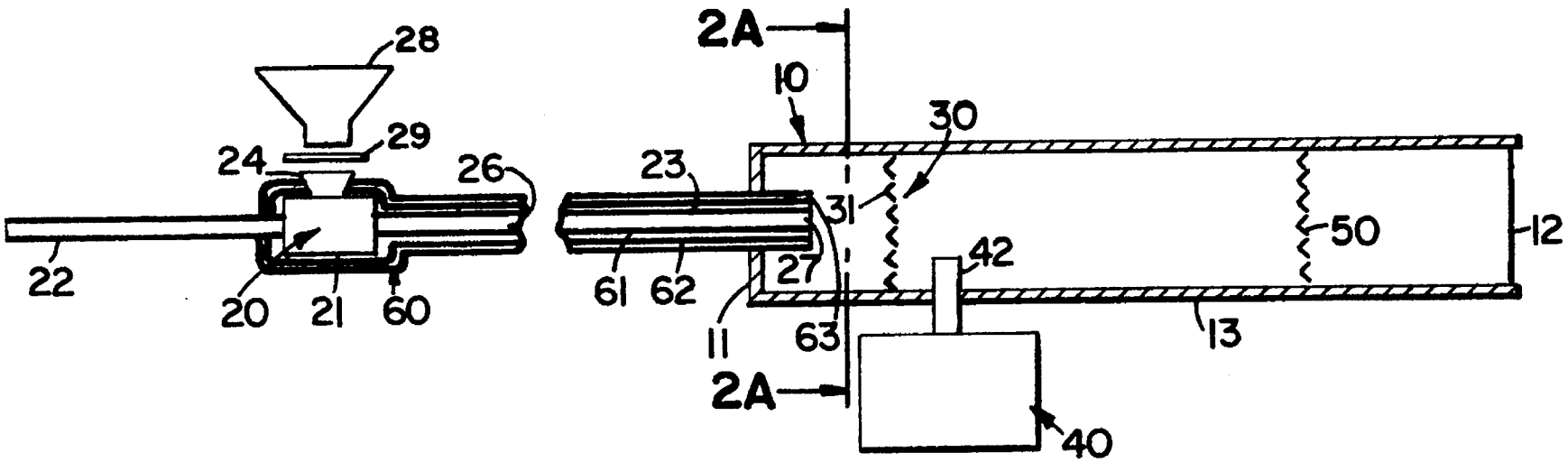
FIG. 1A is a schematic side elevation view of a preferred embodiment of the present invention, not drawn to scale, and with portions thereof broken away.

Referring to the drawings wherein like numerals represent like parts throughout several views, an apparatus for burning energetic material is shown generally in FIG. 1A. The apparatus includes a combustion chamber 10 having an intake end 11 and exhaust end 12, injection system 20 having venturi effect eductor 21, cooling system 60 having a cooling jacket substantially enveloping eductor 21, baffle 30 positioned in chamber 10 in a plane substantially perpendicular to the flow of energetic material through chamber 10, and ignition system 40 having a pilot light positioned in chamber 10 between baffle 30 and exhaust end 12.

Injection system 20 is for injecting energetic material into intake end 11 of chamber 10 at a velocity greater than the flame propagation rate of the energetic material. Cooling system 60 maintains the energetic material below a temperature at which the energetic material ignites. Baffle 30 has at least one point thereon elevated from its plane in the direction of intake end 11 and at least one surface tapering away from the elevated point generally in the direction of exhaust end 12. Finally, ignition system 40 ignites the energetic material and generates a flame front such that baffle 30 maintains the flame front substantially stationary in chamber 10 between baffle 30 and exhaust end 12.

Additionally, in the preferred apparatus, eductor 21 is capable of mixing energetic material from suction input 24 with a motive fluid injected through motive-air input 22. Also, cooling system 60 includes inner liquid cooling jacket 61, and outer air cooling jacket 62 which has discharge port 63 connected to intake end 11 of chamber 10 to inject air into the chamber. In addition, baffle 30 has a plurality of bars 31 disposed in its plane and substantially parallel to one another. Each bar in baffle 30 has two planar surfaces 32 and 33 intersecting about leading edge 34 (shown in FIGS. 2A and 2B). The leading edge is elevated from the plane in the direction of intake end 11 and the planar surfaces taper away from leading edge 34 generally in the direction of exhaust end 12. Finally, the apparatus includes second baffle 50 which is positioned in chamber 10 between ignition system 40 and exhaust end 12. This baffle is similar in construction to baffle 30, and it provides turbulence in chamber 10 downstream of the flame front such that the dwell time of the energetic material in chamber 10 is increased and complete combustion of the material is facilitated.

Injection System

Figure 1B:
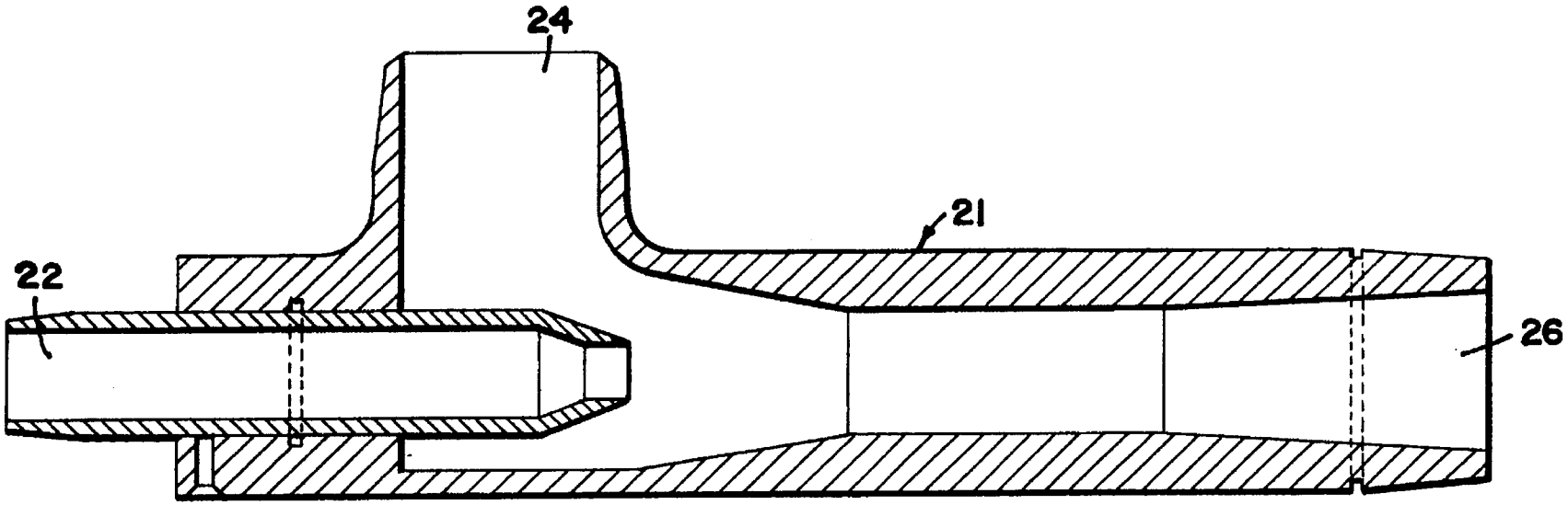
FIG. 1B is a side cross-sectional view of a preferred eductor for use in the present invention.

Injection system 20 conveys fuel or other combustible materials into a burner for combustion purposes. The preferred injection system is a venturi-effect eductor 21, such as a Fox Brand eductor manufactured by Fox Valve Development Corp. of Dover, N.J. The preferred eductor, which is shown in more detail in FIG. 1B, has a motive fluid input 22, a suction input 24, and a discharge port 26. The eductor operates by the venturi principle, whereby a motive fluid injected into the eductor through input 22 creates a vacuum within the eductor, which aspirates material through the suction input 24, and mixes it thoroughly before conveying the mixture of motive fluid and material through discharge port 26 and eventually into the chamber. Discharge port 26 is subsequently connected such that it is able to eject material into the combustion chamber proximate the intake end 11 through tube 23 and nozzle 27.

Motive fluid input 22 provides the input for the desired motive fluid to be used to convey combustible material or fuel into the burner through eductor 21. Motive fluid input 22 is connected to a pump or other mass-moving device (not shown) so that a high volume of motive fluid may be provided into eductor 21. One skilled in the art will appreciate that any suitable motive fluid provider and connection therefor may be connected to suction input 22.

Suction input 24 provides the input for the desired fuel or combustible material (such as an energetic) into eductor 21. Suction input 24 is preferably connected to a feed hopper or storage bin, such as hopper 28, which is disposed above the eductor so that material in the hopper may be gravity fed into the eductor. Alternatively, if the material to be combusted is not readily conveyable, an additional feed pump may be used to inject the material into the eductor under pressure, rather than by gravity. It is preferred to include some feed hopper valve, such as valve 29, which may be used to completely shut off the flow of material to the eductor. This will enable motive fluid flow to be established before fuels are injected, so that a pressure variance is created in the chamber before the injection of the fuel. Fluid flow will also be able to be maintained beyond when the feed is shut down, so that the fuel in the chamber may fully combust before the burner is shut down.

Discharge port 26, tube 23, and nozzle 27 together provide the connection between eductor 21 and combustion chamber 10. The fuel and motive-fluid mixture formed in eductor 21 is transferred into the chamber via this route. Tube 23 is preferably about 3 feet long and 2 inches in diameter. Nozzle 27 preferably projects into the intake end 11 of chamber 10 for a distance of approximately 1/10 the diameter of the combustion chamber, or in the preferred combustion chamber, approximately 2–3". Other dimensions and configurations of tubes and nozzles may be used to convey the mixture into the combustion chamber, so long as excessive heating of the nozzle does not occur.

Eductor 21 is primarily useful for energetics or other combustible materials which are capable of being fluidized, such as granular powder and liquid energetics. Examples of such energetics include smokeless powders, fluid ball powder and nitroglycerine.

An essential characteristic of injection system 20 is that the mixture which is ejected through nozzle 27 is injected at such a rate that flashback of burning material is prevented. This is accomplished by ensuring that the injection rate is above the flame propagation rate of the particular materials which are being injected into the burner. Since energetic materials will typically have burn rates in the order of hundreds or thousands of meters per second, this will typically require a comparable or higher injection rate. For example, in the preferred eductor 20 having a nozzle diameter of about 1.5 inches, an injection rate of about 5 lbs/minute was obtained by providing compressed air at a pressure of about 10 psig to the motive input of the eductor. This enabled approximately 5 pounds of 30 mm smokeless powder to be conveyed per minute.

While ignition system 20 is preferred for energetics which are capable of being fluidized, a number of other injection systems may be used to convey other types of materials. Any such injection system, however, must convey energetics into the burner at a rate higher than that of the flame propagation speed of the injected energetics. For example, a high speed screw pump may be used to convey materials which are not amenable to fluidization.

One such energetic, trinitrotoluene (TNT), is typically in a pasty form, which is often difficult to transport. A screw pump may be used for conveying TNT into the chamber. One skilled in the art will appreciate that many other injection systems which convey energetic material into a burner at a rate faster than the flame propagation rate of the energetic may be used, such as direct injection of liquid through a pressurized nozzle, or a pulse or paddle wheel system for conveying individual packets of energetic material. It is recognized that when using packets of energetic material, slower velocities need to be obtained because their burn rates will be generally slower than those for dry particlized energetics, since burn rate is dependent on the surface area exposed, which decreases for a fixed mass of material as packet size increases.

One additional concern which must be addressed for the burner injection system is that of reducing electrostatic charges. Particularly with granular powder energetics, a buildup of electrostatic charge may result in deposits of energetic material being lodged within the injection system. This is a concern because larger deposits within the injection system may ignite and result in an uncontrolled pressure excursion, and a failure of the injection system. Therefore, it is preferable to include some form of electrostatic charge reduction, typically by providing an air ionizer or by making the eductor tubes out of conductive material such as copper, steel, or aluminum, or lined with conductive plastic (graphite coated).

Cooling System

In order to provide protection against premature ignition, cooling system 60 may be incorporated into the burner. Especially when using energetic material, it is important to cool the injection system for precautionary measures.

The cooling system provides two primary functions. First, it reduces the possibility of premature ignition of the highly volatile energetics by maintaining the temperature of the injection system, and the materials therein, below the critical temperature at which the energetic material ignites. This critical temperature will be different for each energetic material. Second, when air or oxygen is used as a motive fluid, the cooling system increases the density of the fluid (due to lower temperatures) which is injected providing more oxygen for combustion in the chamber.

The preferred cooling system includes an inner cooling jacket 61 which substantially envelops the injection system 20 and has water or some other cooling liquid circulating throughout in order to absorb heat. The amount of envelopment that is required can vary, but for maximum safety, the jacket should be able to cool eductor 21, tube 23 and nozzle 27, to ensure the energetic or combustible material does not ignite prior to injection into the combustion chamber.

Further, an outer air cooling jacket 62 is preferably provided which substantially envelops the inner cooling jacket 61 and circulates air or another cooling gas throughout. Also, for maximum safety, all components of injection system 20 should be covered. Outer cooling jacket 62 preferably also has a discharge port 63 which allows the air which circulates in the cooling jacket to be injected into the chamber, proximate nozzle 27.

The air or other fluid which is provided in the outer air cooling jacket 62 also has a number of functions beyond that of cooling the eductor. First, the air provided into the chamber may provide additional oxygen for more complete combustion. The secondary air may also form a vortex in the chamber to facilitate the stream of energetics or combustible material through the combustion chamber. This vortex may shield the walls of a furnace from heat transfer to some degree, and may contribute to keeping the material airborne. Various cooling fluids may be used in the cooling system, including oxygen, inert substances, inhibitors, liquids, or exhaust gases. These different fluids may have different effects on the combustion properties of the particular combustible material used.

Any number of alternative cooling systems known in the art may be implemented to maintain the energetics below their critical temperature. While either a liquid or air cooling jacket may be used alone to adequately cool the injection system, due to the highly volatile nature of energetics, it has been found that it is preferable to include both a fluid and an air cooling jacket for extra precautionary measures when such energetics are being burned. It is necessary for any alternative cooling systems to be capable, however, of maintaining the combustible mixture below the critical temperature at which it ignites.

Combustion Chamber

The combustion chamber 10 is shown as a cylindrical tube having an intake end 11 and an exhaust end 12. The combustion chamber can take a number of forms, including, for example, a box-like, hexagonal or conical shape.

The preferred dimensions of the combustion chamber are determined by the following equation:

$$\text{length} = \frac{[\text{Average speed (airflow) between baffles(m/s)}]}{[\text{particle mass (g)/burn rate (g/s)}]}$$

The diameter of the chamber is preferably a function of the mass throughput in the chamber. The mass throughput is determined from the eductor input by the following volumetric equation (for a cylindrical chamber):

$$\text{eductor input}(m^3)=(\text{cross-section area}(m^2))\times(\text{length}(m))$$

where:

$$\text{cross-section area (for circle)}=(pi)\times(\tfrac{1}{2}\,d)^2$$

Using the above equations, it has been determined that a combustion chamber of approximately 8 feet long and 24 inches in diameter works sufficiently with a number of energetic materials and flow rates. One skilled in the art, however, will appreciate that a wide variety of sizes and shapes of combustion chambers may be used in the alternative.

Combustion chamber walls 13 are preferably refractory-lined. The refractory is typically a heat resistant material such as fire brick, ceramic fiber (such as manufactured under the trademark Fiberfrax® by Carborundum Corp.), alumina silicates, nickel bearing metals, niobium/columbium/titanium metals, etc. The refractory material soaks up the heat generated in the burner, as well as prevents erosion of the walls due to the excessive heat generated.

In order to effectively use the heat that is generated in the burner, the combustion chamber will typically be attached to a heat exchanger system such as a boiler, an air jacket or water pipes, which absorb the heat that is generated in the burner and transports it away from the burner for heating and/or power generation. This heat exchanger system may either attach to the combustion chamber through the exhaust end, or it may envelop the outer surface of the chamber itself.

Primary Baffle

Baffle 30 is located in the interior of the combustion chamber. It is oriented in a plane which is defined generally perpendicular to the flow of material through the combustion chamber. As a flame front is generated in the burner directly downstream of the baffle 30 (where downstream is defined to be in the direction of the exhaust end 12, and upstream is defined to be in the direction of intake end 11), baffle 30 should be located sufficiently downstream so that the heat which is generated in the burner at the flame front does not reflect back to the ignition system and result in elevated temperatures at the ignition system which may prematurely ignite material flowing through the system. It has been found that a distance preferably in the range of about one inch to 36 inches, and more preferably of about one foot between the nozzle and the baffle is generally sufficient for many energetic materials.

Baffle 30 is used to create a pressure variance in the chamber whenever the high velocity energetic/motive fluid mixture is flowing through the chamber. This pressure variance is preferably a region of reduced pressure created directly downstream of the baffle. The energetic/motive fluid mixture which is injected into the chamber has a velocity, prior to the baffle, which is above the flame propagation rate of the energetic material. Consequently, steady combustion cannot be maintained at this high velocity. The pressure variance created by the baffle, however, operates to reduce the velocity of the mixture, and provide a region where a sustainable combustion may be maintained.

This means of providing a pressure variance, however, must also take into account for the effects of putting any obstruction into a flow of material. Most notably, any obstruction, when used with energetic or other highly reactive materials, must not reflect any material or otherwise allow it to deposit in locations in which safety hazards may result.

FIG. 3 demonstrates some of these undesirable phenomena which would be associated with a simple baffle created from a plurality of parallel flat plates having openings therebetween, as shown in FIG. 3. It can be seen from this Figure that the particular profile of baffle 100 creates a number of undesirable phenomenon, most of which are associated with the buildup or reflection of uncombusted energetic material in portions of the combustion chamber. If sufficient energetic material is allowed to build up, it runs the risk of igniting and detonating (also known as "cooking-off" in the industry).

One concern that must be addressed is the reflection of energetic materials off the face of baffle 100, as shown by particle 105. Any material which is allowed to reflect back off of the baffle can exit the flow of material, and deposit anywhere along the walls of the combustion chamber. Additionally, concerns are raised about the buildup of energetic material along the faces of the baffle 100, as demonstrated by material 103 and 104 deposited on the faces of baffle slats 101 and 102, respectively. While the buildup of material 103 on slat 101 may be reduced by allowing air flow between the slat and the combustion walls, it can be seen that some material will still deposit on the face, such as material 104 on slat 102.

In order to reduce or eliminate these undesirable deposits of energetic material in the burner, it has been found that a preferable baffle design will incorporate a three dimensional shape. In addition, all of the surfaces which face the flow of material should be swept back, and to an extent be aerodynamic in shape, in order to reduce the possibility of reflection and deposit.

This aerodynamic profile may be assured by defining one or more points which are elevated from the plane of the baffle in the direction of the intake end, and having each surface which defines a part of the profile of the baffle tapering away from these points, generally in the direction of the exhaust end. This results in a profile which has one or more "convex" surfaces with relation to the flow of material. "Convex" in this context means generally that if a surface on the baffle were a perfect arc, the point about which the arc revolves would be located downstream (towards the exhaust end).

Figure 4A:
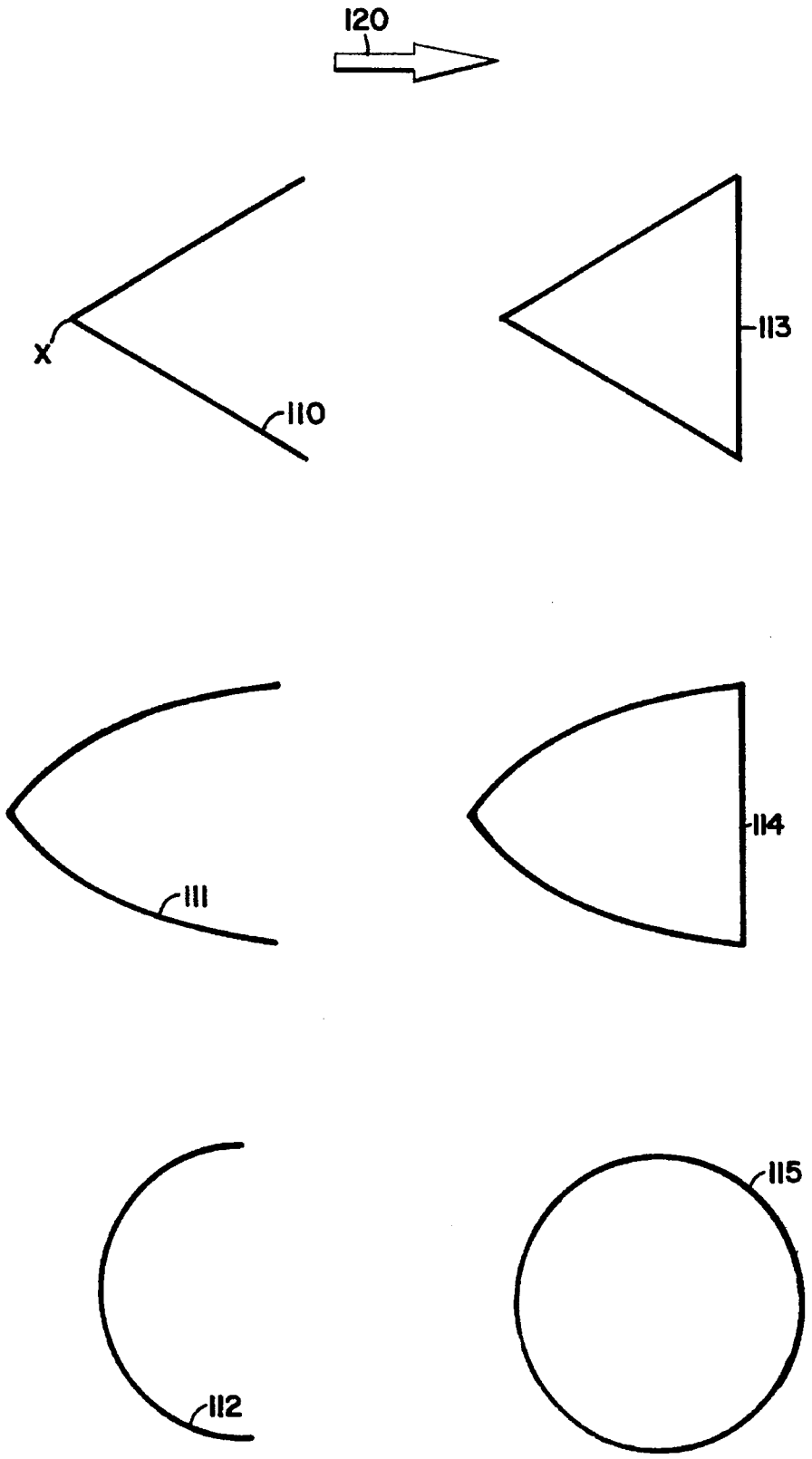
FIG. 4A is a cross-sectional view of a number of exemplary aerodynamic profiles for use consistent with the principles of the invention.

FIG. 4A shows a number of exemplary profiles which conform to a generally "convex" shape. For example, profile 110 shows a pair of planar surfaces which taper away from a leading edge in the direction of air flow, represented by arrow 120. It is this profile which is used in the preferred embodiment. Profile 111 is an ogive shape which generally provides greater aerodynamic flow and less turbulence. Profile 112 may be a partial circular or semi-circular arc which is convex with respect to the direction of flow. The convex arc may be any variety of circular proportions around the point of revolution for the arc, as earlier explained. The area behind the profiles (away from the direction of flow) may be open, as seen in profiles 110, 111 and 112, or may alternately be closed off with a planar surface, as seen in profiles 113 and 114, or a different surface, such as seen in circular profile 115. By differing the areas behind the profiles, various degrees of turbulence may be generated downstream in the flow. These sample profiles are shown herein as only a few possible profiles which may be implemented in the invention. A large variety of other shapes are understood to conform to the teachings of the invention.

The preferred baffle 30, as shown more particularly in FIGS. 2A–B, conforms to this desired profile. Each of the bars in the baffle has an aerodynamic profile with respect to the flow of material. In particular, the bars in baffle 30 are constructed of angle iron, and have been placed in a parallel relationship in a single plane generally perpendicular to the flow of material through the chamber. Each bar is configured to have a desired profile. For instance, bar 31 is configured in the plane such that its leading edge 34 is elevated upstream and toward the intake end from the baffle plane. Further, each of the surfaces 32 and 33 taper away from this leading edge generally downstream and in the direction of the exhaust end of the combustion chamber. Thus configured, reflection and deposit of energetic material is reduced by this aerodynamic profile, while the sufficient obstruction in the flow of material is created to generate a pressure variance downstream of the baffle.

The baffle shown in FIGS. 1A, 2A and 2B has six parallel bars primarily for the purposes of clarity in the drawings. However, in the preferred embodiment, baffle 30 preferably includes between about 1 and 100, and most preferably about 12, bars of angle iron, having overall heights preferably in the range of about 0.1" to 10", and most preferably about 1–. Further, preferably between about 0.1" and 24" inches, and most preferably about 1" inch, are provided between each angle iron to allow for air flow through the baffle.

Figure 4B:
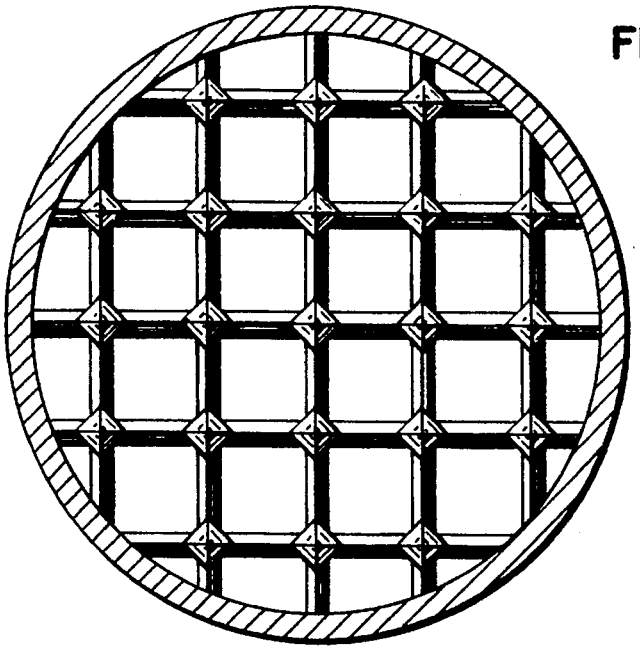
FIG. 4B is a cross-sectional view of an alternative baffle design.

A vast number of baffle designs having the preferred profile can be implemented without departing from the scope of the invention. For instance, the angle irons may be rotated to any relationship within the same baffle plane, for example horizontal, vertical or varying diagonal angles. Further, the baffle plane may be oriented at an angle other than precisely perpendicular to the flow of material through the combustion chamber. Instead of a plurality of parallel bars, a lattice or honeycomb structure may be used having a plurality of aerodynamic members, such as cones or pyramids. One such embodiment is shown in FIG. 4B. Other baffles may have a number of annular concentric rings or conical toroids. In addition, angle iron having a more aerodynamic cross-sectional shape, such as an ogive, may be used to streamline flow prior to reaching the baffle. Also, wing sections may be formed on the surfaces of baffle to form aerodynamic lifting surfaces.

Further, various modifications may be made to the baffle to provide additional functions. For instance, the baffle may have internal passages defined therein to circulate a fluid in order to cool the baffle, and prevent premature ignition of energetic or combustible material prior to being combusted downstream of the baffle. Also, the baffle may have openings for providing additional fuel or combustion air through openings thereon in order to modify the burning characteristics of the mixture that is being combusted. Further, instead of air or fuel, any of the above-mentioned motive fluids may be used to further modify the combustion characteristics of the mixture. A baffle may also be made variable, and may open or close to vary the amount of turbulence generated in the chamber. The baffle surfaces additionally may be textured or alterable (either random or directional) to affect airflow, turbulence and swirling, to increase the intimacy of the air with the burning gases downstream. The baffle trailing edge surfaces may also be notched, serrated, or extended with wires, ribbons or vibrating members (powered or under natural frequency), in order to increase downstream mixing. Any of these alternative baffles, however, preferably should provide the necessary pressure variance while preventing reflection and buildup of material upstream.

Ignition System

Immediately downstream of the baffle 30 (towards the exhaust end of the chamber) is ignition system 40. This ignition system operates to ignite the material as it flows past the baffle and create a sustainable flame front in the combustion chamber. The preferred ignition system has a nozzle 42 into the chamber which is preferably located between about 0.1 and 6 inches, and most preferably about 0.5 inch, from the baffle 30. A flame is generated at this nozzle 42 so that material flowing through the chamber is ignited at that point. Due to the operation of baffle 30, the flame front grows in the direction of the intake end towards the baffle. However, the flame front will not grow any further due to the high velocity mixture which is flowing upstream of the baffle. In this manner, the flame front is prohibited from entering the injection system and causing catastrophic failure.

The preferred ignition system 40 is a propane or natural gas pilot ignition system, with a temperature of at least about 500° C. and having a prepilot electronic ignition. Such ignition systems are well known in the art, for instance, in the area of residential, commercial, or industrial furnaces. A wide variety of alternative ignition systems known in these areas may be implemented in this preferred burner.

Secondary Baffle

In some instances, the flow of material through the combustion chamber may be so great that even fast burning energetic material may not completely combust prior to its ejection out the exhaust end of the chamber. Considering the highly volatile nature of most energetics, releasing partially combusted material out the exhaust end of the chamber may result in obvious safety hazards.

One manner of correcting this problem is to increase the temperature inside the combustion chamber so that materials burn faster. The burn rate is related to the temperature by the following known equation:

$$S_{u1}=S_{u0}+(0.45\times10^{-3})\times(T_1^2-T_0^2)$$

where:

$S_{u1}$=increased flame speed (cm/sec)

$S_{u0}$=starting flame speed (cm/sec)

$T_1$=increased temperature (in Kelvin)

$T_0$=starting temperature (in Kelvin)

However, by increasing the temperature, the risk of premature ignition is increased. Another manner of solving this problem is to increase the length of the combustion chamber so that the material has sufficient time to completely combust prior to ejection through the exhaust end. This may further require a secondary ignition system downstream of the first ignition system, which would generate a second flame front in the combustion chamber.

In addition, a secondary baffle may be placed in the combustion chamber in order to provide turbulence and increase the dwell time of material within the chamber. This would have the effect of reducing the total length of the combustion chamber. This is shown in FIG. 1A as baffle 50. The location of this baffle within the combustion chamber may vary depending upon the energetic being consumed. For example, it has been found that a preferred location is about 60" from the primary baffle for a 30 mm cannon propellant.

Baffle 50 should have much of the same profile characteristics as baffle 30. It is believed, however, that due to the temperatures which exist in the combustion chamber by baffle 50 that the likelihood of potential consequences of reflection or deposition of energetic material would be significantly less. In fact, it may be beneficial to allow some reflection in some instances, as the material may bounce back into the flame front and combust further. However, for maximum protection, the preferred baffle 50 is a plurality of parallel angle iron bars, similar to baffle 30 shown in FIGS. 2A–B.

Baffle 50, similarly to baffle 30, creates a pressure variance and generates turbulence in the flow of the material. It operates to slow the velocity of the flow below that of the flame propagation rate of the material, so that flashback is induced, and a stable flame front is facilitated. Further, it reduces the material propagation speed to allow for more complete combustion of the fuels. One skilled in the art will appreciate that a wide variety of baffle designs, most of which are disclosed above in relation to the primary baffle, are capable of providing these desired functions.

Combustible and Energetic Materials

Burners consistent with the present invention may be used to burn a number of combustible materials, energetic and non-energetic alike. Energetic materials typically include explosives, propellants, and pyrotechnics. The U.S. Department of Transportation generally defines an explosive as any chemical compound, mixture, or device, for which the primary or common purpose of which is to function by explosion, i.e. with substantially instantaneous release of gas and heat. 37 C.F.R. § 173.50(a). Under Federal regulations, propellants and pyrotechnics are also generally included in the classification of explosive. These materials are classified by the DOT based upon their volatility. An exhaustive, but by no means complete, list of energetics is provided in Subpart C of the Department of Transportation Research and Special Programs Administration Regulations, titled "Explosives and Blasting Agents; Definitions and Preparation", 37 C.F.R. §§ 173.50–173.114a (1990).

Energetic materials, for the purposes of this invention include at least those defined above as well as those which are defined as highly volatile materials having high burn rates which are generally above one meter/second (normal fuels, with the exception of hydrogen, generally have a flame speed of less than one meter/second). Examples include ammonium perchlorate (AP); 2,4,6-trinitro-1,3-benzenediamine (DATB); ammonium picrate (Exp D); octahydro-1,3,5,7-tetranitro-1,3,5,7-tetrazocine (HMX); nitrocellulose (NC); nitroguanidine (NQ); 1,3,5-propanetriol trinitrate (NG); 2,2-Bis[(nitroxy)methyl]-1,3 propanediol dinitrate (PETN); 2,4,6 trinitrophenol (TNP); hexahydro-1,3,5-trinitro-1,3,5-triazine (RDX); 2,4,6-trinitro-1,3,5-benzenetriamine (TATB); N-methyl N-2,4,6 tetranitro benzeneamine (TETRL); and 2-methyl-1,3,5 trinitrobenzene (TNT); among others.

Burners consistent with the present invention are also compatible for use with the broader group of combustible materials (i.e. materials or fuel, such as fuel oil, coal, etc., which are capable of being combusted or burned)—energetic and non-energetic alike. The principles of the present invention apply similarly; however, due to the less reactive nature of non-energetic combustible materials, the associated hazards are reduced. In particular, the injection rate doesn't need to be as great as for energetic materials since the burn rate is several magnitudes lower. Also, cooling and other handling requirements would not be as stringent since the likelihood and consequences of unwanted ignitions would be significantly reduced.

Motive Fluids

Burners consistent with the present invention can implement a number of motive fluids which can have various effects on the combustion of the energetics. The preferred motive fluid is air, which usually contains sufficient oxygen to ensure complete combustion of most energetics. However, a number of other motive fluids may be used. For example, the motive fluid may contain additional oxygen, which would facilitate combustion. Alternatively, an inert substance such as nitrogen or water vapor may be used to moderate the combustion of the energetics. Also, an inhibitor such as Halon® may be used to inhibit combustion, which would be useful for energetics having extremely unstable properties.

It may also be preferable to recycle exhaust gases which are ejected from the exhaust end of the combustion chamber back as a component of the motive fluid. Pollution emanated from the burner can be reduced from recycling these exhaust gases, as particulates and other materials present in the gases may be further combusted. Alternatively, because many energetic materials produce relatively high outputs of nitrous oxides ($NO_x$) in their omissions, the exhaust gases may be used to generate nitric acid in a conventional chemical process.

The motive fluid may also be a liquid, such as water or a liquid fuel, which may form mixtures or slurries similar to those used in prior energetic incineration systems. However, unlike these prior systems, the injection system 20 would not require the extensive pumping, circulation, and storage equipment that is found on these prior systems. Also, in general the percentage of energetics in the slurry mixture may be increased beyond that which is recommended for prior systems. The limitation on an injection system used for the preferred burner is the ability to transfer the material. Should the percentage desired produce a more viscous material than could be conveyed by the eductor, any of the alternate injection methods disclosed below would suffice.

Specific examples of preferred motive fluids for use with the present invention include air, nitrogen, water, fuel oil, and argon.

Operation of Burner

The operation of the preferred burner will now be described in the context of burning dry energetic material such as smokeless powder. The dry energetics are preferably preground so that they are particlized into powdery form having particles with a maximum diameter in the range of about 0.10". Under the most basic operating conditions, air can be used as the motive fluid and the cooling fluid for the outer air jacket, and water can be used for the inner cooling jacket.

It has been found that compressed air can be provided as a motive fluid preferably in the range of about 3–10 psig. The velocities achieved using this range of motive fluid will generally be in the range of about 1 to 100 meters per second, and most preferably about 20 meters per second, with a feed rate of the energetic in the range of about 1 to 25 pounds per minute, and most preferably about 10 pounds per minute, depending on the energetic.

In order to operate the burner, the dry energetic is loaded into the hopper. The pumps and/or compressors used for the cooling jacket are first turned on so that water will circulate throughout the inner cooling jacket, and so that air will pass through the outer cooling jacket and be injected into the combustion chamber. The ignition system is next activated, usually by an electronic prepilot igniting the propane pilot light. The motive fluid blower is next turned on to a low pressure in the range of about 1 to 5 psig, and most preferably about 3 psig.

A pressure variance may then be established before energetics enter the chamber. Once established, the feed valve is opened, and a vacuum created within the eductor begins to pull energetic material through its input and into the mixing chamber within the eductor. The energetic material is mixed with the motive air, and then injected into the combustion chamber. The rate at which the material is injected must be above the flame propagation rate of the energetic material. This will prevent flashback into the injection system.

Figure 5A:
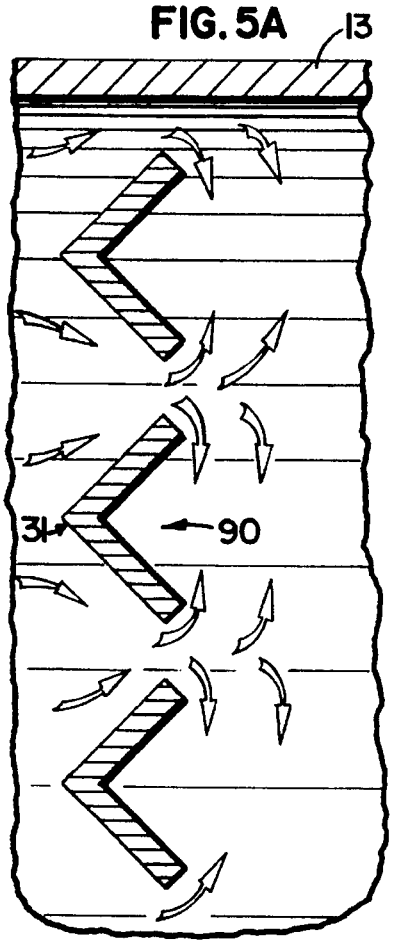
FIG. 5A is an enlarged fragmentary cross-sectional view of the baffle in FIGS. 2A and 2B, demonstrating air flow around the baffle.

When the mixture of motive air and energetic material reaches the baffle in the combustion chamber, a number of phenomena are believed to occur. First, it is believed that the high velocity air passing between the bars in the baffle is slowed, and a pressure variance is created between the upstream and downstream sides of the baffle. Also, it is believed that eddies are formed in the flow of material directly behind each bar of the baffle. This phenomena is shown generally, for example, as low pressure area 90 shown directly behind baffle bar 31 in FIG. 5A. It is believed that these low pressure areas behind the bars are suitable for combustion due to the lowered velocity and pressure existing in the area. Further, it is believed that the entire area immediately behind the baffle and proximate the ignition system has a somewhat reduced velocity and pressure due to the general turbulence that exists downstream in the baffle.

Figure 5B:
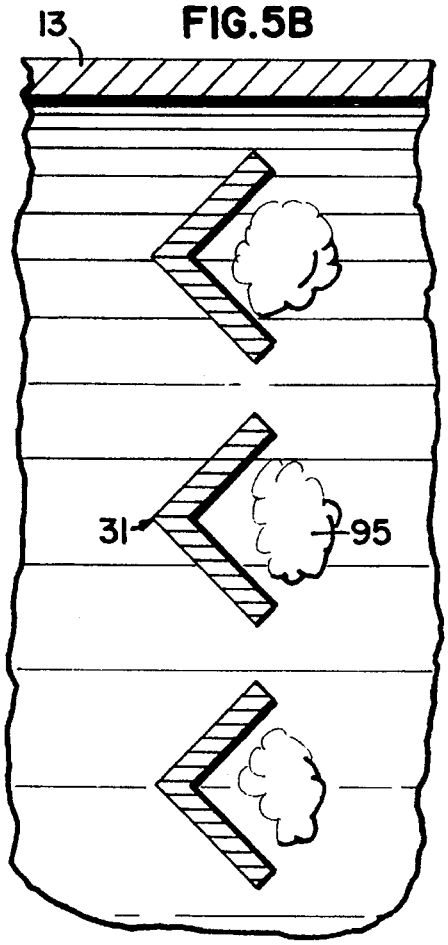
FIG. 5B is an enlarged fragmentary cross-sectional view of the baffle shown in FIGS. 2A and 2B, showing the combustion of material in the combustion chamber.

When energetic material passes through the baffle, it is believed that some of it will come into contact with the pilot flame, and immediately ignite. A flame front will develop and ignite most or all of the energetic material which has already passed through the baffle. It is believed that the eddy areas directly behind each bar in the baffle are the areas of the most stable combustion. As seen in FIG. 5B, combustion will occur directly behind the bars in the baffle. These areas are believed to create, in effect, a number of pilot lights, such as pilot light 95, which will stably combust as long as new material is being injected into the combustion chamber. It is believed that with these areas burning, all energetic material which passes between the bars of the baffle will be ignited by these pilot lights and will fully combust directly downstream of the baffle in the turbulent area of the combustion chamber.

It can also be seen from the profile of the bars in the baffle that when energetic material passes through, any energetic material that comes in contact with the bars will probably be reflected, if at all, through to the downstream side of the baffle. Furthermore, no deposit of energetic material is likely, due to the high velocity air which travels over the leading surfaces of each bar. Thus, it is believed that the build up or reflection of energetic material back into the combustion chamber upstream of the baffle is substantially prevented.

We believe that the flame front which is generated downstream of the baffle is prevented from flashing back into the injection system because the velocity of the air upstream of the baffle is greater than that which would allow a stable flame. However, because of the baffle, it is believed that the flame front is not blown out due to the pilots created directly behind each of the bars and the turbulence that is generated in the chamber downstream of the baffle. If flashback is construed as allowing the flame front to grow or move upstream in the chamber, and blowout is construed as allowing the flame front to grow or move downstream in the chamber, it can be seen that the preferred burner, by preventing both phenomena, maintains the flame front substantially stationary in the chamber downstream and adjacent the baffle. It is this control which ensures stable, efficient and sustainable combustion of the energetic material.

We believe that flashback is also prevented due to the maintenance of the energetic material below its critical temperature prior to being ignited downstream of the baffle, since reaction rate is significantly dependent on temperature. The heat that is generated by the combustion of the energetic material is not allowed to raise the temperature of the energetics sufficiently to preignite them because of the cooling system and the separation of the injection system from the baffle. First, by separating the baffle from the ignition system, it is believed that any heat that is generated is not capable of radiating back toward the injection system to the degree necessary to ignite the energetic material. Further, it is believed that the combination of the inner and outer cooling jackets keeps the energetic material at a reasonable temperature below critical temperatures for the energetics. As stated above, the cooling jackets also increase the density of the motive air, which provides more oxygen necessary for efficient combustion.

The cooling system also provides secondary combustion air which is injected at port 63 into the combustion chamber. In addition to facilitating more efficient combustion, it is believed that the additional air flow may create a vortex in the chamber to facilitate injection of the energetic material into the chamber.

In order to reduce the problem of partially combusted energetic material from exiting the combustion chamber, baffle 50, located downstream of the flame front, creates turbulence similar to that of baffle 30, but uses the turbulence created in a different way than that of baffle 30. It is believed that baffle 50 operates to create flashback, rather than prevent it, because the flame front is upstream, rather than downstream, of the baffle. By providing this flashback, energetic material which is passed beyond the initial stages of the flame front is further combusted because its dwell time is increased by the turbulence generated by baffle 50. In this manner, the possibility of partially combusted energetic material ejecting out the exhaust end of the combustion chamber is reduced.

Preferably, the rate at which energetic material is injected in the combustion chamber is varied by the velocity of the motive air which is provided to the eductor. It is preferable to ramp up the velocity of the air so that the amount of partially combusted energetic material that passes through the combustion chamber is reduced while the burner is in the initial stages of operation (i.e. before operating temperature has been achieved). Furthermore, it is preferable to continue to provide motive fluid for a time period after the last of the energetic material has been injected into the combustion chamber (either because no material exists or because the feed valve is closed), so that all of the energetic material has sufficient time to completely combust before the burner is shut down. We believe that this will reduce the possibility of partially uncombusted material being deposited inside or ejected outside the combustion chamber.

The primary control for the burner is provided through varying the velocity of motive fluid being provided to the eductor. With a venturi-effect eductor, one is usually unable to vary the amount of energetic material which is injected independent of the motive fluid. Rather, the amount of material injected at a particular motive air velocity will typically be near a fixed capacity which has been designed into the eductor. The heating output, therefore, may be regulated simply by varying the velocity of the motive air. However, one skilled in the art would appreciate that, for example, other injection systems may use a separate variable feed valve between the eductor and the storage bin for the energetics in order to vary the rate of the energetic material being supplied to the eductor.

Other more advanced controls may be implemented to provide additional control over combustion. For instance, a variable baffle may be implemented which would open or close to vary the amount of turbulence that it generates. The composition of the motive fluid may be variable, such as in the amount of oxygen or inhibitors which make up the fluid. Also, the feed rate of the energetic material may be varied, as discussed above.

Therefore, it can be seen that the problems of flashback, blowout, premature ignition, and incomplete combustion are substantially reduced by the use of the preferred burner. The resulting combustion in the burner is efficient, sustainable, stable, and controlled, while the hazards from the highly volatile energetics are carefully guarded against.

Some preliminary experimentation was performed using a burner having a 1.5 inch eductor valve in the preferred burner design. Various runs of single and double base propellant energetic were used to test the principles of the present invention. The single base propellant consisted of particles of about 0.07"×0.09" right cylinders, and the double base propellant consisted of particles of about 0.07"× 0.08" right cylinders. It was determined that in small runs of between 0.5 to 10 pounds of the energetic material, and a motive fluid of compressed air at 3–10 psig, a stable combustion could be achieved and a temperature of approximately 1950° F. could be maintained in the combustion chamber. For single base propellant, a feed rate in the range of 10 pounds per minute could be achieved, and for double base propellant, a feed rate of approximately 3–6 pounds per minute could be maintained. In these experiments, no second baffle, such as baffle 50, was used, and it was determined that as much as 20% of the propellant was able to pass through the chamber partially uncombusted.

As has been discussed above, various modifications in structure of the preferred burner may be made which do not depart from the spirit and scope of the present invention. For instance, a number of injection systems may be used which prevent flashback by providing energetic material in the combustion chamber at a rate higher than the flame propagation rate of the energetic material. In addition, a number of structures may be used to provide the pressure variance in the combustion chamber so that the flame front can be maintained substantially stationary in the chamber without blowing out.

For instance, for energetic material such as TNT which is pasty and difficult to convey, alternative injection systems may be implemented. While many prior art slurry-type systems can incorporate these types of energetics, these prior art systems are generally limited to compositions having 30% or less energetics by weight because of safety concerns due to the uncontrolled nature of the combustion of the energetics. However, it has been found that by using any of the injection systems discussed above, the composition of energetics is merely limited by the difficulty to transport them, which it is believed can be as high as 80% or more of the total composition of matter injected into the burner. For instance, a screw pump or pressurized nozzle would be sufficient in many of these cases, as long as the rate of injection is maintained above the flame propagation rate of the material. It is believed that the pressure variance created in the chamber will provide a stable flame front regardless the injection system used.

The principles which are embodied in the preferred burner may also be applied to applications such as vertical draft induced incinerators, rotary kiln incinerators, and fluidized bed incinerators. A primary advantage of using a system consistent with the present invention over the prior art is that the complex and bulky storage and mixing systems which have previously been used are eliminated. It is not necessary to circulate and store energetic material in a slurry having a large quantity of water or fuel oil. Rather, the energetic material may be directly mixed and injected immediately prior to combustion in a burner. For instance, on a vertical draft induced or fluidized bed incinerator, a burner consistent with the present invention may be implemented in lieu of the oil burners which were previously used to provide heat in the incinerators. In, for example, a rotary furnace, the preferred burner may be used to generate the heat in the rotary kiln, rather than the typical oil burners. It is probable that a second baffle would not be implemented in such systems, because the vertical draft, fluidized bed, and rotary chamber would generally provide sufficient turbulence in their respective incinerators to ensure complete combustion of the energetic materials. However, it is not improbable that a second baffle could be implemented in such systems.

It can be seen that, unlike most of the prior incineration methods for energetic material, the use of preferred burners in conjunction with any of the incinerators enables energetic material to be used as the fuel, rather than being used as the material which is incinerated due to the heat generated by an alternate standard fuel. Therefore, excess fuel does not need to be provided in order to maintain heat in the burner. One skilled in the art, however, would appreciate that the principles embodied in the invention may be applied to enable the energetics to be the material to be incinerated, rather than the primary fuel for the incinerator. In essence, a preferred burner, or even simply the direct injection means disclosed above, may replace the bulky and complex mixing and storage systems which are prevalent in many prior art energetic incineration methods.

Finally, it can be seen that the present invention, while primarily providing for the unique hazardous problems associated with energetic materials, also may apply to less volatile combustible materials. However, due to the reduced volatility of such materials, it would not be as difficult to deal with the flashback, blowout, and other phenomena which are associated with the combustion of energetic materials.

The above discussion, examples and embodiments illustrate our current understanding of the invention. However, as one skilled in the art will appreciate that various changes may be made without departing from the spirit and scope of the invention, the invention resides wholly in the claims hereafter appended.

We claim:

1. An apparatus for burning combustible material comprising:

(a) a combustion chamber comprising an interior wall and having an intake end and an exhaust end;

(b) means for injecting the combustible material into the intake end of the chamber;

(c) means for igniting the combustible material whereby a flame front is generated, the ignition means positioned within the chamber; and (d) means for providing a variance in pressure in the chamber between the intake and the ignition means, said pressure variance means comprising a baffle affixed to said combustion chamber interior wall, said baffle positioned in the flow of combustible material through the chamber, the baffle having at least one point thereon elevated from said plane in the direction of the intake end of the chamber and at least one surface tapering away from the elevated point generally in the direction of the exhaust end whereby the flame front is held substantially stationary in the chamber adjacent the pressure variance means.

2. The apparatus of claim 1, wherein the injection means comprises a venturi-effect eductor.

3. The apparatus of claim 2, wherein the eductor comprises means for mixing the combustible material with a motive fluid to form a combustible mixture.

4. The apparatus of claim 1, further comprising means for cooling the injection means such that the combustible material is maintained below a temperature at which the combustible material ignites.

5. An apparatus for burning combustible material comprising:

(a) a combustion chambers having an intake end and an exhaust end;

(b) means for injecting the combustible material into the intake end of the chamber;

(c) means for igniting the combustible material whereby a flame front is generated, the ignition means positioned within the chamber;

(d) means for providing a variance in pressure in the chamber between the intake and the ignition means, whereby the flame front is held substantially stationary in the chamber adjacent the pressure variance means; and (e) means for cooling the injection means such that the combustible material is maintained below a temperature at which the combustible mateiral ignites wherein the cooling means includes a liquid cooling jacket substantially enveloping the injection means.

6. The apparatus of claim 5, wherein the cooling means comprises an air cooling jacket substantially enveloping the injection means and having a discharge port connected to the intake end of the chamber, whereby air injected into the cooling jacket is discharged into the chamber through the discharge port.

7. The apparatus of claim 5, wherein the ignition means comprises a pilot light.

8. The apparatus of claim 5, wherein the pressure variance means provides a region of reduced pressure in the chamber between the intake end and the ignition means.

9. The apparatus of claim 5, wherein the pressure variance means comprises a baffle positioned in the chamber between the intake end and the ignition means, the baffle being in a plane substantially perpendicular to the flow of combustible material, the baffle having at least one point thereon elevated from the plane in the direction of the intake end and at least one surface tapering away from the elevated point generally in the direction of the exhaust end.

10. The apparatus of claim 9, wherein the baffle comprises a plurality of bars disposed in the plane and substantially parallel to one another, wherein each bar in the baffle comprises two planar surfaces intersecting about a leading edge, the leading edge being elevated from the plane in the direction of the intake end and the planar surfaces tapering away from the leading edge generally in the direction of the exhaust end.

11. The apparatus of claim 5, further comprising means for providing turbulence in the chamber between the ignition means and the exhaust end.

12. The apparatus of claim 11, wherein the turbulence means comprises a second baffle positioned in the chamber between the ignition means and the exhaust end, the second baffle comprised of a plurality of bars disposed in a plane substantially perpendicular to the flow of combustible material and substantially parallel to one another, each bar in the second baffle comprising two planar surfaces intersecting about a leading edge, the leading edge being elevated from the plane in the direction of the intake end and the planar surfaces tapering away from the leading edge generally in the direction of the exhaust end.

13. An apparatus for burning energetic material comprising:

(a) a combustion chamber having an intake end and an exhaust end;

(b) means for injecting energetic material into the intake end of the chamber comprising a venturi effect eductor, whereby the eductor accepts energetic material and injects the energetic material into the intake end of the chamber at a velocity greater than a flame propagation rate of the energetic material;

(c) a cooling jacket substantially enveloping the eductor, whereby the cooling jacket maintains the energetic material below a temperature at which the energetic material ignites;

(d) a baffle positioned in the chamber in a plane substantially perpendicular to the flow of energetic material through the chamber, the baffle having at least one point thereon elevated from the plane in the direction of the intake end and at least one surface tapering away from the elevated point generally in the direction of the exhaust end; and (e) a pilot light positioned in the chamber between the baffle and the exhaust end, whereby the pilot light ignites the energetic material and generates a flame front, and the baffle maintains the flame front substantially stationary in the chamber between the baffle and the exhaust end.

14. The apparatus of claim 13, wherein the eductor comprises means for mixing the energetic material with a motive fluid to form a combustible mixture.

15. The apparatus of claim 13, wherein the cooling jacket comprises an inner liquid cooling jacket substantially enveloping the eductor and an outer air cooling jacket substantially enveloping the inner liquid cooling jacket, the outer air cooling jacket having a discharge port connected to the intake end of the chamber, whereby air injected into the outer cooling jacket is discharged into the chamber through the discharge port.

16. The apparatus of claim 13, wherein the baffle comprises a plurality of bars disposed in the plane and substantially parallel to one another, each bar in the baffle comprising two planar surfaces intersecting about a leading edge, the leading edge being elevated from the plane in the direction of the intake end and the planar surfaces tapering away from the leading edge generally in the direction of the exhaust end.

17. The apparatus of claim 13, further comprising a second baffle positioned in the chamber between the pilot light and the exhaust end, the second baffle comprised of a plurality of bars disposed in a plane substantially perpendicular to the flow of energetic material and substantially parallel to one another, each bar in the second baffle comprising two planar surfaces intersecting about a leading edge, the leading edge being elevated from the plane in the direction of the intake end and the planar surfaces tapering away from the leading edge generally in the direction of the exhaust end, whereby the second baffle provides turbulence in the chamber downstream of the flame front such that the dwell time of the energetic material in the chamber is increased and complete combustion of the energetic material is facilitated.

18. An apparatus for burning combustible material comprising:

(a) a combustion chamber having an intake end and an exhaust end;

(b) means for injecting the combustible material into the intake end of the chamber;

(c) means for igniting the combustible material whereby a flame front is generated, the ignition means positioned within the chamber; and (d) means for providing a variance in pressure in the chamber between the intake end and the ignition means, wherein the pressure variance means comprises a baffle positioned in the chamber between the intake end and the ignition means, the baffle being in a plane substantially perpendicular to the flow of combustible material, the baffle having at least one point thereon elevated from the plane in the direction of the intake end and at least one surface tapering away from the elevated point generally in the direction of the exhaust end, wherein the baffle comprises a plurality of bars disposed in the plane and substantially parallel to one another, wherein each bar in the baffle comprises two planar surfaces intersecting about a leading edge, the leading edge being elevated from the plane in the direction of the intake end and the planar surfaces tapering away from the leading edge generally in the direction of the exhaust end, whereby the flame front is held substantially stationary in the chamber adjacent the pressure variance means.

19. An apparatus for burning combustible material comprising:

(a) a combustion chamber having an intake end and an exhaust end;

(b) means for injecting the combustible material into the intake end of the chamber wherein said injection means includes means for injecting the combustible material into said chamber at a velocity greater than the flame propagation rate;

(c) means for igniting the combustible material whereby a flame front is generated, the ignition means positioned within the chamber;

(d) means for providing a variance in pressure in the chamber between the intake end and the ignition means, whereby the flame front is held substantially stationary in the chamber adjacent the pressure variance means; and (e) means for providing turbulence in the chamber between the ignition means and the exhaust end, wherein the turbulence means comprises a baffle positioned in the chamber between the ignition means and the exhaust end, the second baffle comprised of a plurality of bars disposed in a plane substantially perpendicular to the flow of combustible material and substantially parallel to one another, each bar in the second baffle comprising two planar surfaces intersecting about a leading edge, the leading edge being elevated from the plane in the direction of the intake end and the planar surfaces tapering away from the leading edge generally in the direction of the exhaust end.

20. An apparatus for burning energetic material comprising:

(a) a combustion chamber having an intake end and an exhaust end;

(b) means for injecting energetic material into the intake end of the chamber comprising a venturi effect eductor, whereby the eductor accepts energetic material and injects the energetic material into the intake end of the chamber at a velocity greater than a flame propagation rate of the energetic material;

(c) a cooling jacket substantially enveloping the eductor, whereby the cooling jacket maintains the energetic material below a temperature at which the energetic material ignites;

(d) a baffle positioned in the chamber in a plane substantially perpendicular to the flow of energetic material through the chamber, the baffle having at least one point thereon elevated from the plane in the direction of the intake end and at least one surface tapering away from the elevated point generally in the direction of the exhaust end, wherein the baffle comprises a plurality of bars disposed in the plane and substantially parallel to one another, each bar in the baffle comprising two planar surfaces intersecting about a leading edge, the leading edge being elevated from the plane in the direction of the intake end and the planar surfaces tapering away from the leading edge generally in the direction of the exhaust end; and (e) a pilot light positioned in the chamber between the baffle and the exhaust end, whereby the pilot light ignites the energetic material and generates a flame front, and the baffle maintains the flame front substantially stationary in the chamber between the baffle and the exhaust end.

21. The apparatus of claim 20, further comprising a second baffle positioned in the chamber between the pilot light and the exhaust end, the second baffle comprised of a plurality of bars disposed in a plane substantially perpendicular to the flow of energetic material and substantially parallel to one another, each bar in the second baffle comprising two planar surfaces intersecting about a leading edge, the leading edge being elevated from the plane in the direction of the intake end and the planar surfaces tapering away from the leading edge generally in the direction of the exhaust end, whereby the second baffle provides turbulence in the chamber downstream of the flame front such that the dwell time of the energetic material in the chamber is increased and complete combustion of the energetic material is facilitated.

* * * * *